US010155374B2

(12) United States Patent
Ohnishi

(10) Patent No.: US 10,155,374 B2
(45) Date of Patent: Dec. 18, 2018

(54) PRINTING METHOD, PRINTING DEVICE, AND PRINTING SYSTEM

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/549,171

(22) PCT Filed: Mar. 17, 2016

(86) PCT No.: PCT/JP2016/058460
§ 371 (c)(1),
(2) Date: Aug. 7, 2017

(87) PCT Pub. No.: WO2016/158441
PCT Pub. Date: Oct. 6, 2016

(65) Prior Publication Data

US 2018/0029352 A1 Feb. 1, 2018

(30) Foreign Application Priority Data

Apr. 1, 2015 (JP) ..... 2015-075108

(51) Int. Cl.
*B41M 1/12* (2006.01)
*B41C 1/14* (2006.01)
(Continued)

(52) U.S. Cl.
CPC ..... *B41C 1/147* (2013.01); *B05D 1/26* (2013.01); *B41J 11/002* (2013.01); *B41J 11/58* (2013.01); *B41M 1/12* (2013.01); *B41M 7/0081* (2013.01)

(58) Field of Classification Search
CPC ..... B41C 1/147; B41J 11/002; B41J 11/0015; B41J 11/58; B41J 2/0057; B41J 2/01;
(Continued)

(56) References Cited

U.S. PATENT DOCUMENTS 8,408,674 B1 * 4/2013 Crowley ..... B41F 19/007 347/37
2008/0134913 A1 * 6/2008 Sato ..... B41L 13/06 101/118

FOREIGN PATENT DOCUMENTS

JP 08197827 A * 8/1996
JP H11222782 8/1999

OTHER PUBLICATIONS machine translation of detailed description of JP 08-197827 A, which has a publication date of Aug. 1996.*
(Continued)

*Primary Examiner* — Leslie J Evanisko
(74) *Attorney, Agent, or Firm* — JCIPRNET

(57) ABSTRACT

A printing method for carrying out printing with respect to various printing target objects through a more appropriate method using an inkjet head, the printing method including a screen preparing step of preparing a mesh-like screen, an ink discharging step of discharging an ink droplet from the inkjet head to one surface of the screen, a viscosity increasing step of enhancing a viscosity of the ink on the screen, an ink push-in step of pushing the ink with enhanced viscosity from the one surface side toward other surface side of the screen, the step including pushing in the ink while a medium, or a target object of printing, and the other surface of the screen are making contact to attach the ink with enhanced viscosity to the medium, and an ink fixing step of fixing the ink attached to the medium to the medium.

11 Claims, 7 Drawing Sheets

(51) Int. Cl.

| | |
|---|---|
| ***B05D 1/26*** | (2006.01) |
| ***B41J 11/00*** | (2006.01) |
| ***B41J 11/58*** | (2006.01) |
| ***B41M 7/00*** | (2006.01) |

(58) Field of Classification Search
CPC ..... B05D 1/26; B41M 1/12; B41F 17/003; B41F 19/007; B41F 23/04
USPC ..... 101/129
See application file for complete search history.

(56) References Cited

OTHER PUBLICATIONS

"International Search Report (Form PCT/ISA/210) of PCT/JP2016/058460", dated Jun. 21, 2016, with English translation thereof, pp. 1-4.

* cited by examiner

PRINTING METHOD, PRINTING DEVICE, AND PRINTING SYSTEM

CROSS-REFERENCE TO RELATED APPLICATION

This application is a 371 of international application of PCT application serial no. PCT/JP2016/058460, filed on Mar. 17, 2016, which claims the priority benefits of Japan application no. 2015-075108, filed on Apr. 1, 2015. The entirety of each of the abovementioned patent applications is hereby incorporated by reference herein and made a part of this specification.

TECHNICAL FIELD

The present invention relates to a printing method, a printing device, and a printing system.

BACKGROUND ART

Screen printing method such as silk printing method, and the like are conventionally known for a method capable of printing on various printing target objects (see e.g., Patent Literature 1). The screen printing method is a method of, for example, carrying out printing using a screen (gauze) woven with fibers such as polyester. In the screen printing method, a method of pushing out ink from the screen is adopted, so that a layer of ink formed on the printing target object can be formed thick compared to the other printing methods. Furthermore, printing target objects made from various materials and having various shapes can be used for the printing target object.

CITATION LIST

Patent Literature

Patent Literature: Japanese Unexamined Patent Publication No. 11-222782

SUMMARY

Technical Problems

When carrying out printing through screen printing, a proof adapted to an image to be printed is created in advance, and ink is pushed out from an area corresponding to an opening of the proof in the screen to attach the ink to the printing target object. In this case, however, the proof needs to be created in advance, and hence printing takes great trouble. Furthermore, when the number of copies for printing the same image is small, the cost of printing per copy becomes higher due to the cost for creating the proof. Thus, a method for carrying out printing through a more appropriate method with respect to various printing target objects is conventionally desired. The present invention provides a printing method, a printing device, and a printing system capable of solving the problems described above.

Solutions to the Problems

With respect to the problems described above, the inventor of the present invention first contrived carrying out printing using an inkjet head as a method different from the conventional screen printing method. When the inkjet head is used, various images can be printed without creating a proof in advance.

In the inkjet head, however, there are various restrictions on the ink that can be used in terms of the principle of discharging an ink droplet from a microscopic nozzle. For example, the viscosity of the ink is desirably a low viscosity such as smaller than 20 mPa·sec so that the ink can be discharged from the nozzle. In this case, problems such as smearing of the ink, and the like easily occur compared to the case of using the screen printing method. As a result, for example, it may become difficult to form a thick layer of ink obtained when the screen printing method is used.

Through further thorough research, the inventor of the present invention considered combining the screen and the inkjet head rather than just using the inkjet head. It was found that the advantages of both the conventional screen printing method and the printing method using the inkjet head, for example, can be thereby obtained. In order to solve the problem described above, the present invention has the following configurations.

(Configuration 1) A printing method for carrying out printing using an inkjet head, the printing method includes a screen preparing step of preparing a mesh-like screen; an ink discharging step of drawing an image on the screen by discharging an ink droplet from the inkjet head with respect to one surface of the screen; a viscosity increasing step of enhancing a viscosity of an ink on the screen; an ink push-in step of pushing in the ink, whose viscosity is enhanced in the viscosity increasing step, from the one surface side toward other surface side of the screen, the step including pushing in the ink while a medium, or a target object of printing, and the other surface of the screen are making contact to attach the ink with enhanced viscosity to the medium; and an ink fixing step of fixing the ink attached to the medium to the medium.

According to such configuration, the image to be printed can be appropriately drawn on the screen without using a proof by using the inkjet head. Furthermore, the ink on the screen can be appropriately prevented from smearing, and the like by enhancing the viscosity of the ink in the viscosity increasing step. The ink thus can be appropriately pushed in the subsequent ink push-in step. Furthermore, for example, the thickness of the ink on the screen can be appropriately thickened, as necessary, by enhancing the viscosity of the ink in the viscosity increasing step. A sufficient amount of ink thus can be attached to the medium, and a vivid color can be obtained.

Furthermore, in this case, the operation of pushing in the ink in the ink push-in step can be carried out in the same manner as or in a manner similar to the conventional screen printing method. Thus, the printing can be appropriately carried out on the medium made from various materials and having various shapes in a manner similar to the case of carrying out the printing through the conventional screen printing method. Therefore, according to such configuration, the printing can be more appropriately carried out on various media without creating the proof in advance.

In this configuration, the mesh-like screen is a screen having an array of holes that can permeate ink, whose viscosity is enhanced in the viscosity increasing step. A thin fabric woven with warp and woof, and the like, for example, can be suitably used for the screen. More specifically, for example, a gauze woven with synthetic fiber such as polyester, silk, and the like can be suitably used for the screen. Furthermore, for example, consideration is made to using a screen made from metal, various net-like screens, a mesh-like screen formed by etching, or the like. A screen same as or similar to the screen used in the known screen printing method, for example, may be used for the screen.

In the screen preparing step, for example, a screen stretched across a frame body is prepared. Furthermore, in the screen preparing step, the prepared screen is preferably installed with the inkjet head and one surface facing each other and the other surface and the medium making contact with each other.

Moreover, in the ink fixing step, the process of fixing the ink to the medium such as irradiation of the ultraviolet ray, heating, and the like is preferably carried out with the screen spaced apart from the medium. According to such configuration, the ink on the medium can be appropriately fixed to the medium while preventing the ink remaining on the screen from fixing on the screen. In this case, the removal of the ink on the screen becomes easier, and hence the screen can be reused.

(Configuration 2) The ink push-in step includes pushing in the ink from the one surface side toward the other surface side of the screen while vibrating the screen. In this case, the medium is also preferably vibrated with the screen. In this case, for example, consideration is made to vibrating the screen by pushing in the ink while vibrating the push-in member, which is a member used to push in the ink. The frequency of vibration is in a range of a few to a few dozen kHz. The vibration frequency is preferably in the range of 1 to 90 kHz, and more preferably in the range of about 5 to 50 kHz.

According to such configuration, the ink can be more smoothly passed with respect to the screen. Furthermore, the ink thus can be more appropriately attached to the medium. For example, when using a medium that absorbs ink at least to a certain extent as with the fabric medium such as cloth, for example, the ink can be moderately impregnated to the inside of the medium by applying vibration. The ink thus can be more appropriately attached to the medium.

(Configuration 3) The medium is a fabric medium having gigging on a surface; and in the ink push-in step, the other surface of the screen is brought into contact with the surface of the medium while holding down the gigging. According to such configuration, the influence of gigging can be appropriately alleviated by holding down the gigging at the surface of the medium with the screen. The printing thus can be more appropriately carried out with respect to the fabric medium having the gigging on the surface.

(Configuration 4) The screen preparing step causes the medium and the other surface of the screen to be brought into contact; and operations of at least the ink discharging step, the viscosity increasing step, and the ink push-in step are carried out while maintaining the contact between the medium and the other surface of the screen. According to such configuration, the operation of each step can be appropriately carried out while maintaining a position relationship of the medium and the screen. Thus, the printing on the medium can be more appropriately carried out at high precision.

(Configuration 5) A layer of ink with enhanced viscosity is formed in plurals on the screen by repeating the operation of the ink discharging step and the operation of the viscosity increasing step over plural times; and the ink push-in step includes pushing the plurality of layers of ink toward the medium.

According to such configuration, the layer of ink having thickness can be appropriately formed on the screen, and appropriately pushed in toward the medium. A sufficient amount of ink thus can be attached to the medium, and a vivid color can be more appropriately obtained. Furthermore, if a sufficient amount of ink can be attached to the medium, for example, the weather proof property of the ink can be enhanced, and the like.

(Configuration 6) The ink push-in step uses a push-in member for pushing in the ink on the one surface of the screen toward the other surface to push in the ink toward the medium. According to such configuration, the ink can be more appropriately pushed in toward the medium.

A member used to push in the ink in the known screen printing method, and the like, for example, can be suitably used for such push-in member. More specifically, for example, a squeegee, a roller, a pad, or the like can be suitably used for the push-in member.

(Configuration 7) The push-in member is a slidably moving member that slidably moves on the one surface of the screen; and the ink push-in step includes pushing the ink on the one surface of the screen toward the medium by slidably moving the slidably moving member with a hold-down sheet, or a sheet for holding down the ink on the screen, sandwiched between the ink on the one surface of the screen and the slidably moving member.

When pushing in the ink using the slidably moving member, flow of the ink on the screen in a lateral direction, which is a slidably moving direction of the slidably moving member, and the like by the slidable movement of the slidably moving member is also considered. The ink may attach to an unintended area or the quality of printing may lower, as a result, in the medium. According to such configuration, on the other hand, the influence that arises when the ink flows can be appropriately alleviated. The ink thus can be more appropriately pushed in toward the medium.

A squeegee, a roller, and the like, for example, can be suitably used for the slidably moving member. A film, and the like can be suitably used for the hold-down sheet. A film made from a material to which the ink is less likely to attach is preferably used for such film. More specifically, polypropylene film, and the like, for example, can be suitably used for such film.

(Configuration 8) The inkjet head discharges an ink droplet of an ultraviolet curing type ink that cures by irradiation of an ultraviolet ray; the viscosity increasing step enhances the viscosity of the ink in a range of viscosity with which the ink can pass the screen in the ink push-in step by irradiating the ink with an ultraviolet ray of an integrated intensity under which the ink does not completely cure; and the ink fixing step fixes the ink to the medium by further irradiating the ink on the medium with the ultraviolet ray.

According to such configuration, the viscosity of the ink can be appropriately enhanced in the viscosity increasing step. Furthermore, the ink pushed in in the ink push-in step can be appropriately fixed to the medium in the ink fixing step.

(Configuration 9) The inkjet head discharges an ink droplet of an ink that fixes to the medium by evaporating a solvent; the viscosity increasing step enhances the viscosity of the ink in a range of viscosity with which the ink can pass the screen in the ink push-in step by volatilizing and removing one part of the solvent in the ink; and the ink fixing step fixes the ink to the medium by further volatilizing and removing the solvent in the ink on the medium.

According to such configuration, the viscosity of the ink can be appropriately enhanced in the viscosity increasing step. Furthermore, the ink pushed in in the ink push-in step can be appropriately fixed to the medium in the ink fixing step.

The ink that fixes to the medium by evaporating the solvent is, for example, a latex ink, an aqueous ink, and the like. Furthermore, consideration is made to using ink in which various types of resin are dispersed in aqueous solvent, and the like. The solvent ink having the hydrophobic organic solvent as the solvent, and the like, for example, may be considered for use depending on the demanded print quality.

(Configuration 10) The inkjet head discharges an ink droplet of an ink that fixes to the medium by being irradiated with an ultraviolet ray after evaporating a solvent; the viscosity increasing step enhances the viscosity of the ink in a range of viscosity with which the ink can pass the screen in the ink push-in step by volatilizing and removing at least one part of the solvent in the ink; and the ink fixing step fixes the ink to the medium by irradiating the ink on the medium with the ultraviolet ray. In this case, the ink includes at least, for example, the solvent and the ultraviolet curing type resin. The solvent UV ink containing the hydrophobic organic solvent as the solvent, an aqueous UV ink containing an aqueous solvent for the solvent, and the like, for example, can be used for such ink.

According to such configuration, the viscosity of the ink can be appropriately enhanced in the viscosity increasing step. Furthermore, the ink pushed in in the ink push-in step can be appropriately fixed to the medium in the ink fixing step.

Furthermore, in this case, the viscosity of the ink can be appropriately enhanced while preventing the viscosity of the ink from being enhanced in excess in the viscosity increasing step by differing the method for enhancing the viscosity of the ink in the viscosity increasing step and the method for fixing the ink in the ink fixing step. The ink thus can be more appropriately pushed in in the ink push-in step.

(Configuration 11) A printing method for carrying out printing using an inkjet head, the method includes a screen preparing step of preparing a mesh-like screen; an ink discharging step of drawing an image on the screen by discharging an ink droplet from the inkjet head with respect to one surface of the screen; a viscosity increasing step of enhancing a viscosity of an ink on the screen; a transferring step of transferring the ink, whose viscosity is enhanced in the viscosity increasing step, to a medium, or a target object of printing, the step including pressing the screen against the medium while the one surface of the screen and the medium are making contact to attach the ink with enhanced viscosity to the medium; and an ink fixing step of fixing the ink attached to the medium to the medium.

When configured in such manner, the viscosity of the ink can be appropriately enhanced to the viscosity suited for transfer by enhancing the viscosity of the ink in the viscosity increaser. Furthermore, the direct transfer from the screen to the medium thus can be appropriately carried out in the transferring step. Thus, according to such configuration, the printing can be appropriately carried out with respect to the medium made from various materials and having various shapes.

In this case, the extra ink can be absorbed into the screen or toward the other surface side of the screen at the time of transfer in the transferring step by carrying out the transfer using the mesh-like screen. Thus, according to such configuration, the printing through transfer can be more appropriately carried out even when the ink to use is in large amount.

In the transferring step, for example, the screen may be pressed against the medium while vibrating the screen. According to such configuration, the ink can be more appropriately attached to the medium. In this case, the medium is also preferably vibrated with the screen. The frequency of vibration is in a range of a few to a few dozen kHz. The vibration frequency is preferably in the range of 1 to 90 kHz, and more preferably in the range of about 5 to 50 kHz.

(Configuration 12) A printing device used in the printing method according to any one of configurations 1 to 11, the printing device includes the inkjet head that discharges an ink droplet; a screen holder that holds the screen with the one surface of the screen facing the inkjet head; and a viscosity increaser that enhances a viscosity of the ink on the screen. According to such configuration, effects similar to configurations 1 to 11 can be obtained.

In this configuration, the inkjet head discharges the ink droplet to one surface of the screen in the ink discharging step. Furthermore, the screen holder holds the screen at least while the ink discharging step is being earned out. The screen holder preferably continues to hold the screen even while the viscosity increasing step is being carried out after the ink discharging step. Furthermore, the screen is more preferably continuously held even while the ink push-in step is being carried out. The viscosity increaser enhances the viscosity of the ink in the viscosity increasing step. A device adapted to the ink to use is preferably used for the viscosity increaser. More specifically, for example, consideration is made to using a heater, an ultraviolet light source, and the like for the viscosity increaser.

(Configuration 13) A printing system for carrying out printing using an inkjet head, the printing system includes an inkjet head that discharges an ink droplet to one surface of a mesh-like screen to draw an image on the screen; a screen holder that holds the screen with the one surface of the screen facing the inkjet head; a viscosity increaser that enhances a viscosity of the ink on the screen; a push-in member that pushes the ink, whose viscosity is enhanced in the viscosity increasing step, from the one surface side toward other surface of the screen, the push-in member pushing in the ink while a medium, or a target object of printing, and the other surface of the screen are making contact to attach the ink with enhanced viscosity to the medium; and an ink fixer that fixes the ink attached to the medium to the medium.

The printing method described in configuration 1, and the like can be carried out using the printing system having such configuration. According to such configuration, effects similar to configuration 1 and the like can be obtained.

(Configuration 14) A printing system for carrying out printing using an inkjet head, the printing system includes an inkjet head that discharges an ink droplet to one surface of a mesh-like screen to draw an image on the screen; a screen holder that holds the screen with the one surface of the screen facing the inkjet head; a viscosity increaser that enhances a viscosity of the ink on the screen; a transferring member used in a transferring operation of transferring the ink, whose viscosity is enhanced in the viscosity increasing step, to a medium, or a target object of printing, the transferring member pressing the screen against the medium while the one surface of the screen and the medium are making contact to attach the ink with enhanced viscosity to the medium; and an ink fixer that fixes the ink attached to the medium to the medium.

The printing method described in configuration 11, and the like can be carried out using, for example, the printing system having such configuration. According to such configuration, effects similar to configuration 11 and the like can be obtained.

Effect of the Invention

According to the present invention, the printing can be carried out through a more appropriate method with respect to the printing target objects.

BRIEF DESCRIPTION OF THE DRAWINGS

FIG. 1A shows one example of a configuration of a printing device 10 used in the printing method of the present example. FIG. 1B is a flowchart showing one example of an operation in the printing method of the present example.

FIG. 2A is a side cross-sectional view showing one example of a configuration of an intermediate medium 100 used in the present example. FIG. 2B is a bottom view of the intermediate medium 100 shown in FIG. 2A. FIG. 2C shows one example of a state in which a medium 50 and the intermediate medium 100 are held by the holder unit 18.

FIG. 3A is a view describing an ink discharging step S104 and a viscosity increasing step S106 in further detail. FIG. 3B is a view describing an ink push-in step S108 in further detail. FIG. 3C is a view describing an ink fixing step S110 in further detail.

FIG. 4A shows one example of the operations of the ink discharging step S104 and the viscosity increasing step S106 carried out in the present variant. FIG. 4B shows one example of the operation of the ink push-in step S108 carried out in the present variant. FIG. 4C shows one example of the operation of the ink fixing step S110 carried out in the present variant.

FIG. 5A shows one example of the operation of the screen preparing step S102 carried out in the present variant. FIG. 5B shows one example of the operations of the ink discharging step S104 and the viscosity increasing step S106 carried out in the present variant. FIG. 5C shows one example of the operation of the ink push-in step S108 carried out in the present variant. FIG. 5D shows one example of the operation of the ink fixing step S110 carried out in the present variant.

FIGS. 6A, 6B and 6C are views showing one example of the operation for when vibrating the screen 102 in the ink push-in step S108.

FIG. 7A shows one example of the operation of the transferring step for when using the heater 20 in the viscosity increasing step S106. FIG. 7B shows one example of the operation of the transferring step for when not using the heater 20 in the viscosity increasing step S106.

DESCRIPTION OF EMBODIMENT

Figure 1A:
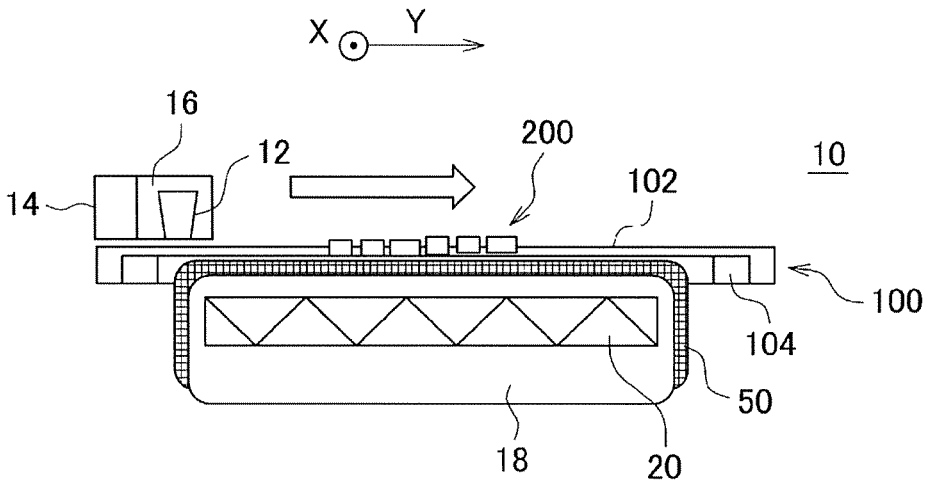
FIGS. 1A and 1B are views showing one example of a printing method according to one embodiment of the present invention.
Figure 1B:
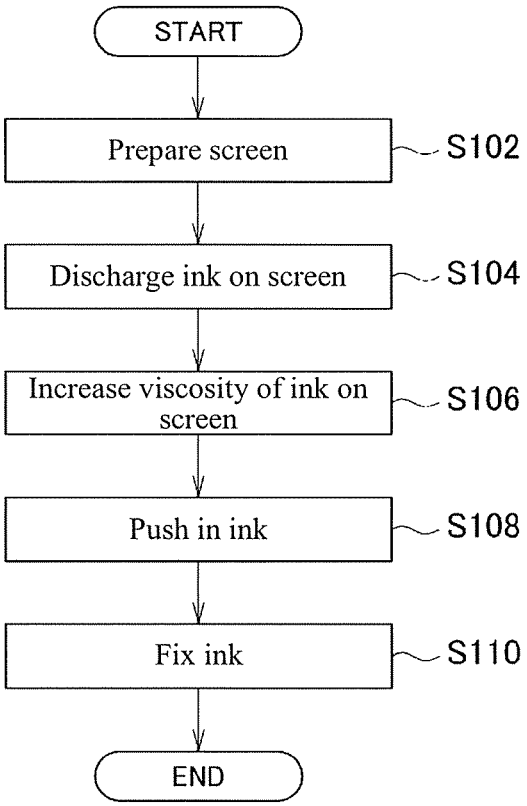

Hereinafter, an embodiment according to the present invention will be described with reference to the drawings. FIGS. 1A and 1B are views show one example of a printing method according to one embodiment of the present invention. FIG. 1A shows one example of a configuration of a printing device 10 used in the printing method of the present example. The printing device 10 configures at least one part of a printing system that executes the printing method of the present example.

The printing device 10 is an inkjet printer that carries out printing through an inkjet method, and includes an inkjet head 12, an ultraviolet light source 14, a carriage 16, a holder unit 18, and a heater 20. Furthermore, in the present example, the printing device 10 carries out printing on a medium (media) 50, which is a printing target object, by way of an intermediate medium 100 rather than by directly discharging the ink droplet onto the medium 50.

Raised fabric textile, which is a fabric medium having gigging on the surface, for example, is used for the medium 50. Consideration is made to using a fabric including gigging such as towel cloth, carpet, and the like for such medium 50. Use of a seat of a seating, and the like, for example, can also be considered. The configuration of the intermediate medium 100, and the operation of printing on the medium 50 carried out by way of the intermediate medium 100 will be described in detail later.

The inkjet head 12 is a print head that discharges ink droplets. In the present example, the inkjet head 12 discharges an ink droplet of a solvent UV ink (Solvent Ultra Violet (SUV) ink) to the intermediate medium 100 to attach the ink, denoted with a reference numeral 200, to the intermediate medium 100. The inkjet head 12 thereby draws an image, set in advance according to an image to be drawn on the medium 50, on the intermediate medium 100.

The solvent UV ink is, for example, an ink containing a solvent, having a hydrophobic organic solvent as a main component, and an ultraviolet curable resin. In this case, the solvent having the hydrophobic organic solvent as the main component is, for example, a solvent in which greater than or equal to 50% by weight of the component is a hydrophobic organic solvent. The ultraviolet curable resin is, for example, a monomer, an oligomer, and the like that cure by irradiation of an ultraviolet ray. A cationic polymerization ink, radical polymerization solvent UV ink, and the like, for example, can be suitably used for the solvent UV ink.

The solvent UV ink is an example of an ink that fixes to the medium when irradiated with the ultraviolet ray after evaporating the solvent. In a more generalized manner, an ink containing at least the solvent and the ultraviolet curable resin, for example, can be used for such ink. More specifically, other than the solvent UV ink, consideration is made to using an aqueous UV ink containing an aqueous solvent for the solvent, and the like, for example, for such ink.

The inkjet head 12 discharges the ink droplet onto the intermediate medium 100 by carrying out a main scanning operation of discharging the ink droplet while being moved in a main scanning direction (Y direction in the figure) set in advance. Furthermore, a position that faces the inkjet head 12 in the intermediate medium 100 is sequentially changed by carrying out a sub-scanning operation of relatively moving with respect to the intermediate medium 100 in a sub-scanning direction (X direction in the figure) orthogonal to the main scanning direction between the main scanning operations. Furthermore, the ink droplet is discharged to each position of the intermediate medium 100 to draw the image by repeatedly carrying out the main scanning operation and the sub-scanning operation.

In order to simplify the explanation, a configuration where the printing device 10 includes only one inkjet head 12 is illustrated in FIG. 1A. However, the printing device 10 may include a plurality of inkjet heads 12. In this case, each of the plurality of inkjet heads 12 discharges, for example, an ink droplet of a color different from each other.

The ultraviolet light source 14 is a light source that irradiates the ink on the intermediate medium 100 with the ultraviolet ray. Furthermore, in the present example, the ultraviolet light source 14 has a configuration for enhancing the viscosity of the ink on the intermediate medium 100 with the heater 20, and emits a weak ultraviolet ray to such an extent that the ink does not completely cure to enhance the viscosity of the ink. UVLED, and the like, for example, can be suitably used for the ultraviolet light source 14.

The carriage 16 is a holding unit that holds the inkjet head 12 while facing the inkjet head toward the intermediate medium 100. In the present example, the carriage 16 holds the ultraviolet light source 14 with the inkjet head 12. Furthermore, at the time of the main scanning operation, the ultraviolet light source 14 is, for example, moved in the main scanning direction along a guide rail (not shown) to move the inkjet head 12 and the ultraviolet light source 14 in the main scanning direction.

The holder unit 18 is a holding member that holds the medium 50 and the intermediate medium 100 at a position facing the inkjet head 12. Furthermore, in the present example, the holder unit 18 interiorly accommodates the heater 20 at a position facing the inkjet head 12. The heater 20 is a heater that heats a region where the ink is attached in the intermediate medium 100, and enhances the viscosity of the ink by volatilizing and removing the volatile organic solvent, which is the solvent in the ink, by heating.

As also described above, the ultraviolet light source 14 is also arranged in addition to the heater 20 for the configuration of enhancing the viscosity of the ink in the present example. However, if the viscosity of the ink can be appropriately enhanced with only the heater 20, the ultraviolet light source 14 may be omitted in the printing device 10. Furthermore, the operation for increasing the viscosity of the ink will be described in further detail later.

In the description made above, a description is made focusing only on the main configuration of the printing device 10, for the sake of convenience of explanation. However, excluding the points described above and below, the printing device 10 may have a configuration same as or similar to the known inkjet printer. For example, the printing device 10 may further include a driving unit (main scanning driving unit) that causes the inkjet head 12 to carry out the main scanning operation, a driving unit (sub-scanning driving unit) that causes the inkjet head to carry out the sub-scanning operation, and the like. Moreover, a control unit that controls the operation of each unit of the printing device 10, and the like, may be further arranged.

According to the above configuration, the printing device 10 discharges the ink droplet onto the intermediate medium 100 to draw an image. In the printing method of the present example, an operation of attaching the ink on the intermediate medium 100 to the medium 50, and the like are thereafter performed to carry out printing on the medium 50. The operation of the printing method of the present example thus will be described below in further detail.

FIG. 1B is a flowchart showing one example of an operation in the printing method of the present example. In the printing method of the present example, a mesh-like screen 102 is first prepared (screen preparing step S102). In this case, for example, consideration is made to preparing a screen stretched across a frame body. More specifically, in the present example, the screen 102 is prepared by preparing the intermediate medium 100 including the screen 102 and a supporting frame 104.

The mesh-like screen 102 is a screen having an array of holes that can permeate ink, whose viscosity is enhanced in a subsequently carried out viscosity increasing step. For example, a thin fabric woven with warp and woof, and the like can be suitably used for the screen 102. Furthermore, the supporting frame 104 is a frame-like body across which the screen 102 is stretched. The supporting frame 104 is, for example, a frame-like body in which a central part is passed through, and holds the screen 102 by stretching the screen 102 across the pass-through portion.

Furthermore, according to the present example, in the screen preparing step S102, the prepared screen 102 is installed with the inkjet head 12 in the printing device 10 and one surface facing each other and the other surface and the medium 50 making contact with each other. More specifically, using the holder unit 18 with a flat upper surface in the printing device 10, the medium 50 and the intermediate medium 100 are held with the holder unit 18 so as to sandwich the medium 50 between the upper surface of the holder unit 18 and the other surface of the screen 102. Thus, the holder unit 18 is caused to function as a screen holder, and the screen 102 is held by the holder unit 18 with the one surface of the screen 102 and the inkjet head 12 facing each other and the other surface of the screen 102 and the medium 50 making contact with each other.

A screen same as or similar to the screen used in the known screen printing method, for example, can be suitably used for the screen 102. For example, a gauze woven with synthetic fiber such as polyester, silk, and the like can be suitably used for the screen 102. Furthermore, other than the polyester, a mesh-like screen fainted with nylon, tetron, and the like can be suitably used.

Moreover, other than the fabric, and the like, for example, consideration is made to using a metal mesh-like screen made from metal, various net-like screens, a mesh-like screen formed by etching, or the like for the screen 102. Furthermore, consideration is also made to using a screen 102 in which a plurality of (e.g., two) mesh-like bodies of the same or different types are overlapped, a screen 102 reinforced with various types of reinforcement frames and reinforcement nets, and the like.

Following the screen preparing step S102, the ink droplet is discharged from the inkjet head 12 to one surface of the screen 102 to draw an image on the screen 102 (ink discharging step S104) in the printing method of the present example. In this case, drawing an image on the screen 102 refers to forming a layer of ink for representing an image to be printed eventually on the medium 50 on the screen 102. The image refers to, for example, a pattern including pictures, characters, and the like. Furthermore, the image to be printed may be, for example, one part of the image to be eventually drawn on the medium 50.

Following the ink discharging step S104, the viscosity of the ink on the screen 102 is enhanced (viscosity increasing step S106) in the printing method of the present example. Furthermore, in the present example, at least one part of a solvent such as a volatile organic solvent in the ink is volatilized and removed using the heater 20 as a viscosity increaser for enhancing the viscosity of the ink on the screen 102. The viscosity of the ink is thereby enhanced in a range of viscosity with which the ink can pass the screen 102 in a subsequently carried out ink push-in step S108. According to such configuration, for example, smearing of the ink on the screen 102, and the like can be appropriately prevented.

In order to appropriately prevent the smearing of the ink, and the like, the viscosity of the ink is desirably enhanced to higher than or equal to 200 mPa·sec, and preferably higher than or equal to 1000 mPa·sec in the viscosity increasing step S106. Thus, in the present example, the ink in which the viscosity in a state the solvent is evaporated becomes higher than or equal to 200 mPa·sec is preferably used, and the viscosity is more preferably higher than or equal to 1000 mPa·sec.

Furthermore, in the present example, a weak ultraviolet ray can be emitted from the ultraviolet light source 14 in addition to the heating by the heater 20, as described above. Thus, in the viscosity increasing step S106, the ink may be irradiated with the ultraviolet ray from the ultraviolet light source 14, as necessary. According to such configuration, the viscosity of the ink can be enhanced in a shorter time. The smearing of the ink thus can be more appropriately prevented.

Following the viscosity increasing step S106, the ink with enhanced viscosity is pushed in from one surface side toward the other surface side of the screen 102 (ink push-in step S108) in the printing method of the present example. More specifically, pressurization or pressing is carried out with the other surface of the screen 102 and the medium 50 making contact with each other, and the ink is pushed in to attach the ink with enhanced viscosity to the medium 50. The image drawn on the screen 102 is thereby transferred to the medium 50.

In the present example, a fabric medium having gigging on the surface, and the like is used, as described above, for the medium 50. In this case, the other surface of the screen 102 is brought into contact with the surface of the medium 50 so as to hold down the gigging in the ink push-in step S108. According to such configuration, the ink can be more appropriately attached to the fabric medium 50 having gigging on the surface.

Furthermore, in the ink push-in step S108, the pushing-in of the ink is carried out using a push-in member that pushes the ink on one surface of the screen 102 toward the other surface side. The ink can be appropriately pushed in toward the medium 50 by pushing in the ink using the push-in member.

A member used to push in the ink in the known screen printing method, and the like, for example, can be suitably used for such push-in member. More specifically, consideration is made to using a slidably moving member that slidably moves on one surface of the screen 102 for the push-in member. In this case, a squeegee (spatula), a roller, and the like can be suitably used for the slidably moving member.

When pushing in the ink using the slidably moving member, flow of the ink on the screen in a lateral direction, which is a slidably moving direction of the slidably moving member, and the like by the slidable movement of the slidably moving member is also considered. The ink may attach to an unintended area or the quality of printing may lower, as a result, in the medium 50.

Thus, when pushing in the ink using the slidably moving member in the ink push-in step S108, the slidably moving member may be slidably moved with a film sandwiched between the ink on one surface of the screen 102 and the slidably moving member. In this case, the film functions as a hold-down sheet that holds down the ink on the screen 102. A film made from a material to which the ink is less likely to attach is preferably used for such film. More specifically, polypropylene film, and the like, for example, can be suitably used for the film. According to such configuration, the influence that arises when the ink flows can be appropriately alleviated. Other than the film, consideration is made to using a mesh-like sheet, and the like for the hold-down sheet. Furthermore, a pad, and the like, for example, may be used other than the squeegee, and the like for the push-in member.

Following the ink push-in step S108, the ink attached to the medium 50 is fixed to a medium (ink fixing step S110) in the printing method of the present example. Furthermore, in the present example, the ink is fixed to the medium 50 by irradiating the ink on the medium 50 with the ultraviolet ray in the ink fixing step S110.

Moreover, in the ink fixing step S110, the ultraviolet ray is preferably emitted with the screen 102 spaced apart from the medium 50 to fix the ink on the medium 50. According to such configuration, the ink on the medium 50 can be appropriately fixed while preventing the ink remaining on the screen 102 from fixing on the screen 102. In this case, the removal of the ink on the screen 102 through washing, and the like becomes easier, and hence the screen 102 can be reused.

The irradiation of the ultraviolet ray in the ink fixing step S110 can be considered to be performed, for example, using a strong ultraviolet light source separate from the ultraviolet light source 14 in the printing device 10. According to such configuration, a strong ultraviolet ray can be more appropriately irradiated. In this case, a wider region on the medium 50 such as the entire region where the ink is attached, and the like in the medium 50 can be collectively irradiated with the ultraviolet ray.

Furthermore, the irradiation of the ultraviolet ray in the ink fixing step S110 may be carried out using the ultraviolet light source 14 in the printing device 10. In this case, in the ink fixing step S110, the ultraviolet light source 14 irradiates the ink on the medium 50 with, for example, the ultraviolet ray having an integrated intensity for completing the curing of the ink.

When carrying out the irradiation of the ultraviolet ray even in the viscosity increasing step S106, for example, with the ultraviolet light source 14, consideration is made to differing the intensity of the ultraviolet ray between the time of irradiation of the ultraviolet ray in the viscosity increasing step S106 and the time of irradiation of the ultraviolet ray in the ink fixing step S110. For example, when not irradiating the ultraviolet ray in the viscosity increasing step S106, the ultraviolet light source 14 may be used only as an ink fixer.

According to the present example, the image to be printed can be appropriately drawn on the screen 102 without using a proof by using the inkjet head 12 in the ink discharging step S104. Furthermore, the ink on the screen 102 can be appropriately prevented from smearing, and the like by enhancing the viscosity of the ink in the viscosity increasing step S106. The ink thus can be appropriately pushed in in the subsequent ink push-in step S108. Furthermore, the thickness of the ink on the screen 102 can be appropriately thickened, as necessary, by enhancing the viscosity of the ink in the viscosity increasing step S106. A sufficient amount of ink thus can be attached to the medium 50, and a vivid color can be obtained.

Furthermore, when using the fabric medium 50 having gigging on the surface as in the present example, a state as if the ink is floating near the surface of the gigging tends to be easily realized if the printing is directly carried out with the inkjet head. This is because as the capacity of the ink droplet is extremely small, the ink droplet flying toward the medium 50 does not have the force to hold down the gigging and reach the surface of the fabric. In this case, the ink in an unstable state tends to be accumulated, and hence the smearing of the ink, and the like tend to easily occur. Furthermore, when using inks of a plurality of colors, for example, the mixing of color becomes inappropriate, and the desired color may not be appropriately represented.

On the contrary, according to the present example, the influence of gigging can be appropriately alleviated by holding down the gigging at the surface of the medium 50 with the screen 102. The printing thus can be more appropriately carried out with respect to the fabric medium 50 having the gigging on the surface.

Furthermore, for example, when carrying out printing directly on the medium 50 with the inkjet head 12, pre-process, post-process, and the like, which are troublesome, are sometimes required depending on the material, and the like of the medium 50. More specifically, for example, when using the medium 50 made from a material the ink tends to easily smear, the pre-process, and the like for preventing the smearing are sometimes necessary. Furthermore, for example, when carrying out printing on the fabric medium 50 using a sublimation ink, and the like, the post-process, and the like such as steaming for color developing the ink are sometimes necessary. The printing may not be appropriately carried out on the thick piled medium 50 such as the carpet and the medium 50 having high absorption property even if the above processes are carried out.

In the case of the present example, on the other hand, a method of attaching the ink to the medium 50 in a manner similar to the conventional screen printing method is adopted, and hence the printing can be appropriately carried out without carrying out the troublesome pre-process, post-process, and the like if the medium is such that the conventional screen printing method can be applied thereto. Thus, according to the present example, the printing can be more easily and appropriately carried out on various media 50.

Furthermore, in the present example, the operation of pushing in the ink in the ink push-in step S108 can be carried out in the same manner as or in a manner similar to, for example, the conventional screen printing method. Thus, in addition to the case of using the fabric medium 50 having gigging, the printing can be appropriately carried out on the medium 50 made from various materials and having various shapes in a manner similar to the case of carrying out the printing through, for example, the conventional screen printing method. Therefore, according to the present example, the printing can be more appropriately carried out on various media 50 without creating the proof in advance.

Furthermore, in the present example, the method of enhancing the viscosity of the ink in the viscosity increasing step S106 and the method of fixing the ink in the ink fixing step S110 can be differed by using the solvent UV ink. Thus, the viscosity of the ink can be appropriately enhanced while preventing the viscosity of the ink from being excessively enhanced in the viscosity increasing step S106. The ink thus can be appropriately pushed in the ink push-in step S108.

In the case of the present example, the ink with enhanced viscosity is attached to the medium 50, so that the ink can be appropriately prevented from entering inside of the medium 50 more than necessary. The proportion of the ink attached to the vicinity of the surface of the medium 50 can be thereby increased, and a dark color can be more appropriately represented. Thus, according to the present example, the printing of high color development property can be more appropriately carried out.

Furthermore, in the description made above, a case in which the operation of the ink discharging step S104 and the operation of the viscosity increasing step S106 are carried out one time each has been described for the sake of simplification of the explanation. However, at the time of the actual printing, for example, the operation of the ink discharging step S104 and the operation of the viscosity increasing step S106 are preferably repeated over plural times. According to such configuration, the layer of ink with enhanced viscosity can be formed in plurals on the screen 102.

In this case, the ink push-in step S108 pushes in a plurality of layers of ink toward the medium 50. According to such configuration, the layer of ink having thickness can be appropriately formed on the screen 102, and appropriately pushed in toward the medium 50. A sufficient amount of ink thus can be attached to the medium 50, and a vivid color can be more appropriately obtained. Furthermore, if a sufficient amount of ink can be attached to the medium 50, for example, the weather proof property of the ink can be enhanced, and the like.

In order to more appropriately attach the ink to the medium 50, the operations of the ink discharging step S104 and the viscosity increasing step S106 are preferably repeated until the thickness of the ink on the screen 102 becomes the same extent as or greater than the screen 102. Furthermore, consideration is made to increase the size of a dot of the ink formed on the screen 102 by the ink droplet discharged from the inkjet head 12, as necessary.

As also described above, the printing device 10 may include, for example, a plurality of inkjet heads 12 that respectively discharges an ink droplet of a color different from each other. In this case, the printing to the medium 50 is carried out using the inks of a plurality of colors. According to such configuration, a high brilliant color print can be appropriately carried out without using the proof.

More specifically, for example, consideration is made to carrying out the ink discharging step S104, the viscosity increasing step S106, and the ink push-in step S108 for every color after the screen preparing step S102. In this case, after the operations of the ink discharging step S104, the viscosity increasing step S106, and the ink push-in step S108 are carried out with respect to the ink of one color, the operations of the ink discharging step S104, the viscosity increasing step S106, and the ink push-in step S108 are carried out with respect to the ink of another color. In this case, the operation of the ink fixing step S110 may be collectively carried out for the inks of all the colors. In this case as well, the proof does not need to be created for every color, and thus the cost of printing can be appropriately suppressed. Furthermore, in this case, the inks of different colors can be appropriately prevented from mixing, and the like, and hence a high quality printing can be more appropriately carried out.

The operation of each step may be carried out by, for example, simultaneously using the inks of the plurality of colors depending on the demanded quality, and the like of the printing. In this case, the ink droplet is discharged to the screen 102 using the plurality of inkjet heads 12 in the ink discharging step S104. The subsequent operations are also simultaneously carried out with respect to the inks of the plurality of colors. According to such configuration, the printing using the inks of the plurality of colors can be carried out with a simpler process.

In the conventional screen printing method, a separate proof needs to be prepared for every color when, for example, attempting to carry out the printing using a plurality of colors. As a result, the cost of printing greatly increases. In the present example, on the other hand, the printing can be carried out without using the proof even when using the inks of a plurality of colors, as described above. Thus, according to the present example, the printing using the inks of a plurality of colors can be more appropriately carried out at low cost.

Figure 2A:
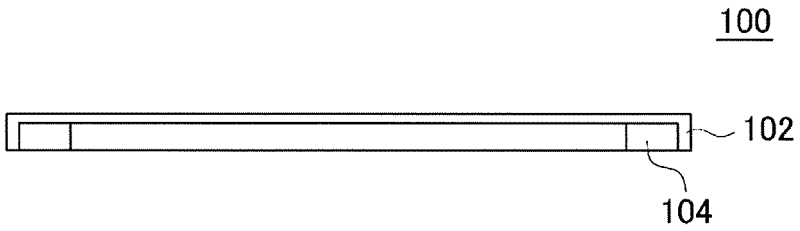
FIGS. 2A to 2C are views describing a screen preparing step S102 in further detail.
Figure 2B:
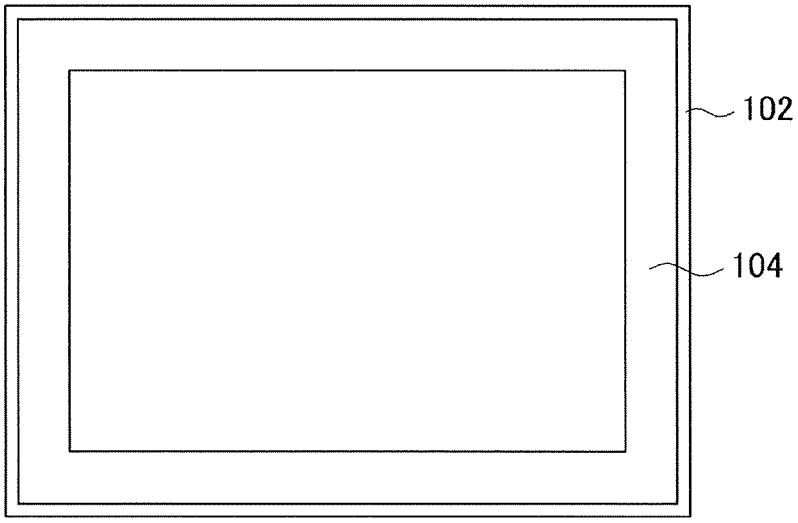
Figure 2C:
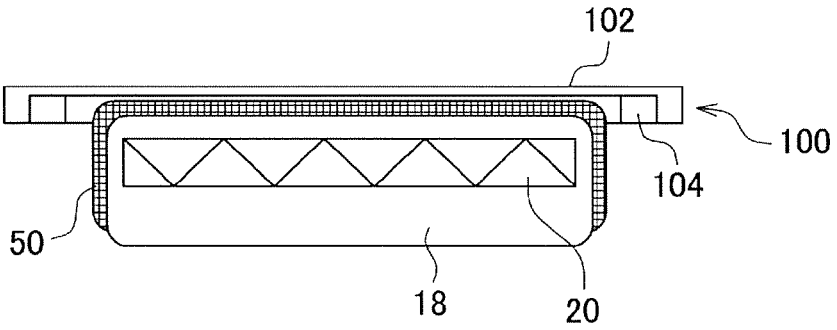

Next, the operation of each step carried out in the printing method of the present example will be more specifically described. FIGS. 2A to 2C are views describing the screen preparing step S102 in further detail. FIG. 2A is a side cross-sectional view showing one example of a configuration of the intermediate medium 100 used in the present example. FIG. 2B is a bottom view of the intermediate medium 100 shown in FIG. 2A. In this case, the bottom view is a view showing the intermediate medium 100 when seen from a surface side that makes contact with the medium 50. FIG. 2C shows one example of a state in which the medium 50 and the intermediate medium 100 are held by the holder unit 18.

As also described in relation to FIGS. 1A and 1B, in the screen preparing step S102 of the present example, the screen 102 is prepared by preparing the intermediate medium 100 in which the screen 102 is stretched across the supporting frame 104, which is the frame body. With respect to the prepared screen 102, the medium 50 and the intermediate medium 100 are held by the holder unit 18 so as to sandwich the medium 50 between the upper surface of the holder unit 18 and the screen 102.

In the present example, after the screen 102 and the medium 50 are brought into contact in the screen preparing step S102, the operations of the ink discharging step S104, the viscosity increasing step S106, and the ink push-in step S108 are carried out while maintaining such contacted state. According to such configuration, the operation of each step can be appropriately carried out while maintaining a position relationship of the medium 50 and the screen 102. Thus, the printing on the medium 50 can be more appropriately carried out at high precision.

Figure 3A:
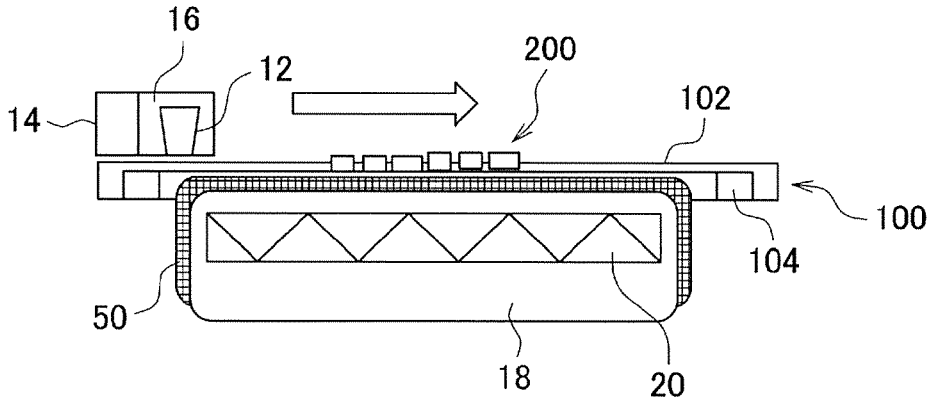
FIGS. 3A to 3C are views describing the operation of each step carried out following the screen preparing step S102 in further detail.
Figure 3B:
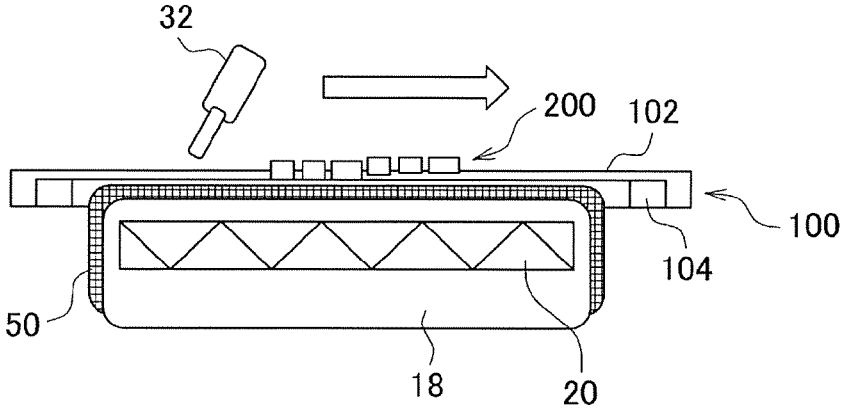
Figure 3C:
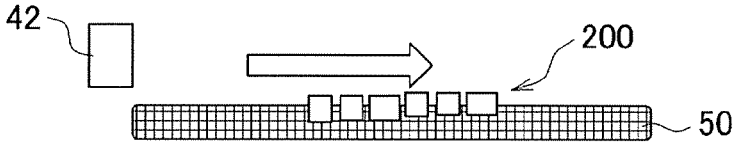

FIGS. 3A to 3C are views describing the operation of each step carried out following the screen preparing step S102 in further detail. FIG. 3A is a view describing the ink discharging step S104 and the viscosity increasing step S106 in further detail.

As also described in relation to FIGS. 1A and 1B, in the ink discharging step S104 of the present example, the ink droplet is discharged from the inkjet head 12 in the printing device 10 to the screen 102. The ink is thereby attached to the screen 102, for example, as shown with the reference numeral 200 in the figure.

Furthermore, in the viscosity increasing step S106, the solvent (volatile organic solvent, etc.) in the ink on the screen 102 is volatilized and removed by heating the screen 102 with the heater 20 in the printing device 10, thus enhancing the viscosity of the ink. Moreover, in the viscosity increasing step S106, the ink on the screen 102 is irradiated with a weak ultraviolet ray using the ultraviolet light source 14 in the printing device 10, as necessary.

FIG. 3B is a view describing the ink push-in step S108 in further detail. In the ink push-in step S108 of the present example, for example, the ink on the screen 102 is pushed in so as to push the ink, whose viscosity is enhanced in the viscosity increasing step S106, into the mesh of the fabric using a squeegee 32. The ink is thereby passed with respect to the mesh-like screen 102, and the ink is attached to the medium 50 making contact with the other surface of the screen 102.

As also described above, the squeegee 32 is an example of the push-in member and the slidably moving member used in the ink push-in step S108. A roller, a pad, and the like, for example, may also be used for the push-in member. In this case, a roller made of rubber, metal, or plastic, and the like, for example, can be suitably used for the roller. For example, a pad formed with an elastic member such as rubber can be suitably used for the pad. Furthermore, in the ink push-in step S108, the media 50 is preferably pressed with the push-in member by way of the screen 102 to blend the attached ink to the medium 50.

When the ink flows in the slidably moving direction of the squeegee 32, and the like and the smearing of ink occurs, the ink is preferably pushed in with the hold-down sheet such as the film sandwiched between the screen 102 and the squeegee 32. In particular, the hold-down sheet is preferably used, for example, when the layer of ink on the screen 102 is thick, when simultaneously pushing in the inks of a plurality of colors, and the like.

When using the push-in member other than the squeegee 32, for example, when using the roller that moves on the screen 102, the hold-down sheet such as the film is preferably used, in a manner similar to the case of pushing in the ink with the squeegee 32. When using the pad, and the like for the push-in member, on the other hand, the hold-down sheet does not need to be used even if the layer of ink is thick, and the like as long as the pad, and the like are not moved in the lateral direction.

FIG. 3C is a view describing the ink fixing step S110 in further detail. In the present example, the irradiation of the ultraviolet ray in the ink fixing step S110 is carried out, for example, with the screen 102 detached from the medium 50, as shown in the figure. According to such configuration, the ink on the medium 50 can be more appropriately irradiated with the ultraviolet ray.

As also described above, consideration is made to carrying out the irradiation of the ultraviolet ray in the ink fixing step S110 using, for example, a strong ultraviolet light source separate from the ultraviolet light source 14 in the printing device 10. Thus, in FIG. 3C, a configuration in the case of irradiating the ultraviolet ray using an ultraviolet light source 42 separate from the ultraviolet light source 14 as the ink fixer is shown. The ultraviolet light source 42 emits the ultraviolet ray stronger than the ultraviolet light source 14 to complete the curing of the ink attached to the medium 50. In this case, completing the curing of the ink refers to curing the ink to the necessary hardness by irradiating the ink with the ultraviolet ray of a sufficient integrated intensity according to the quality demanded on printing.

Furthermore, the ultraviolet light source 42 may be, for example, held by the carriage 16 (see FIGS. 1A and 1B) in the printing device 10 with the inkjet head 12 and the ultraviolet light source 14. In this case, the ultraviolet light source 42, for example, emits the ultraviolet ray to each position on the medium 50 by carrying out scanning in the main scanning direction. Furthermore, the ultraviolet light source 42 may be disposed at a position other than on the carriage 16. An ultraviolet ray irradiation device prepared separately from the printing device 10, for example, may be used for the ultraviolet light source 42.

According to the present example, the operation of each step in the operation of printing can be appropriately carried out. Thus, the printing can be appropriately carried out on the medium 50 using the inkjet head 12, the screen 102, and the like.

Next, various variants for the printing method of the present example will be described. First, a variant in which the medium 50 used as a target object of printing is differed will be described.

In the above description, a case of carrying out printing on the fabric medium 50 having gigging has been mainly described. However, consideration is made to using other various media 50 for the target object of printing. For example, consideration is made to using various media that can be printed with the conventional screen printing method for the medium 50. More specifically, for example, consideration is made to using various fabric media 50 other than the fabric having gigging. Furthermore, for example, consideration is made to using the processed fabric medium 50 such as clothing including T shirt, and the like.

Furthermore, for example, consideration is made to using a medium 50 having irregularities on the surface and the like such as a print paper, Japanese paper, and the like of luster tone or matte tone such as matte paper. Furthermore, consideration is also made to using the medium 50 made of various materials such as glass, which surface is a rough surface of matte form or irregular form, frosted glass, metal, plastic, or the like. Consideration is also made to using a three-dimensional object, and the like for the medium 50.

When using such media 50, the printing can be appropriately carried out, in a manner similar to the conventional screen printing method, even if, for example, the irregularity difference on the surface of the medium 50 is large. In such a case as well, the proof does not need to be used, as described above. Thus, according to such configuration, the printing can be appropriately carried out at low cost on various media 50.

Furthermore, an example of a case of using the solvent UV ink has been mainly described above. However, in a variant of the printing device 10 and the printing method, consideration is also made to using an ink other than the solvent UV ink.

For example, in a configuration same as or similar to the printing device 10 shown in FIGS. 1A and 1B, consideration is made to using an aqueous UV ink, and the like for the ink that fixes to the medium 50 when irradiated with the ultraviolet ray after the solvent is evaporated. Consideration is also made to using an ink that fixes to the medium 50 by evaporating the solvent, and the like for the ink used in the inkjet head 12 by changing one part of the printing device 10 according to the ink to use.

In such a case, the ink that fixes to the medium 50 by evaporating the solvent is, for example, a latex ink, an aqueous ink, and the like. The latex ink is, for example, an ink that contains a polymer material and a solvent, and that fixes the polymer material to the medium by drying. The polymer material is, for example, an aqueous polymer material. Furthermore, the polymer material is, for example, a rubber-like polymer material.

When using such ink, the viscosity of the ink is enhanced by volatilizing and removing one part of the solvent in the ink in the viscosity increasing step S106. Furthermore, in the ink fixing step S110, the ink is fixed to the medium 50 by further volatilizing and removing the solvent in the ink on the medium 50. According to such configuration, the viscosity of the ink can be appropriately enhanced in the viscosity increasing step S106. Furthermore, in the ink fixing step S110, the ink can be appropriately fixed to the medium 50.

Consideration is also made to using an ultraviolet curing type ink (UV ink) for the ink used in the inkjet head 12 by changing one part of the printing device 10 according to the ink to use. In this case, the ultraviolet curing type ink is an ink that cures by the irradiation of the ultraviolet ray. A cationic polymerization ink, radical polymerization UV ink, and the like, for example, can be suitably used for the ultraviolet curing type ink. When using such ink, the viscosity of the ink is enhanced by irradiating the ultraviolet ray having an integrated intensity at which the ink does not completely cure in the viscosity increasing step S106. Furthermore, in the ink fixing step S110, the ink is fixed to the medium 50 by further irradiating the ink on the medium 50 with the ultraviolet ray. According to such configuration, the viscosity of the ink can be appropriately enhanced in the viscosity increasing step S106. Furthermore, in the ink fixing step S110, the ink can be appropriately fixed to the medium 50.

Various inks can be used other than the inks described above. For example, consideration is made to using an ink in which various types of resin are dispersed in the aqueous solvent, and the like other than the latex ink. More specifically, for example, consideration is made to using a thermoplastic resin dispersed aqueous ink in which the thermoplastic resin is dispersed in the aqueous medium. Consideration is also made to using an ink in which a thermoplastic binder resin and a coloring agent are dispersed in the solvent, an ink in which the colored thermoplastic binder resin is dispersed in the solvent, and the like. The solvent ink having the hydrophobic organic solvent as the solvent, for example, may be considered for use depending on the demanded print quality. Furthermore, consideration is also made to using a mixed ink in which two or more types of the various inks described above are mixed.

Figure 4A:
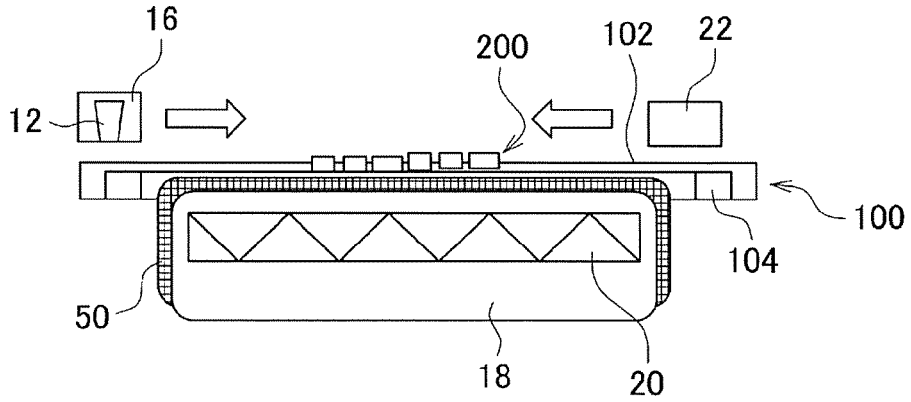
FIGS. 4A to 4C are views showing one example of an operation of printing in the case of using an ink that fixes to the medium 50 by evaporating the solvent.
Figure 4B:
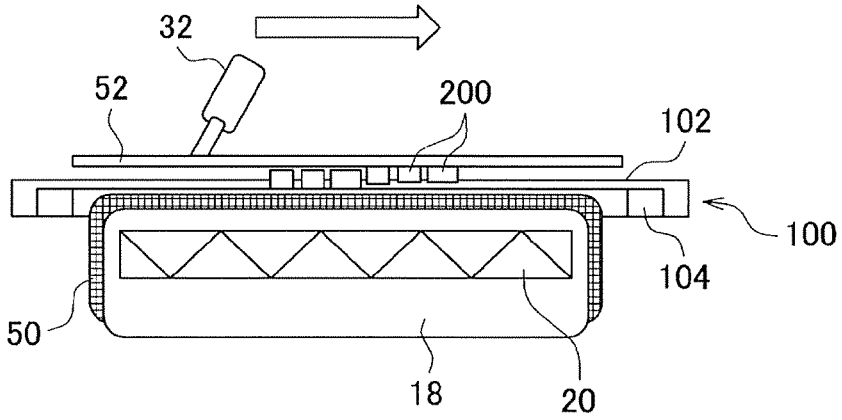
Figure 4C:
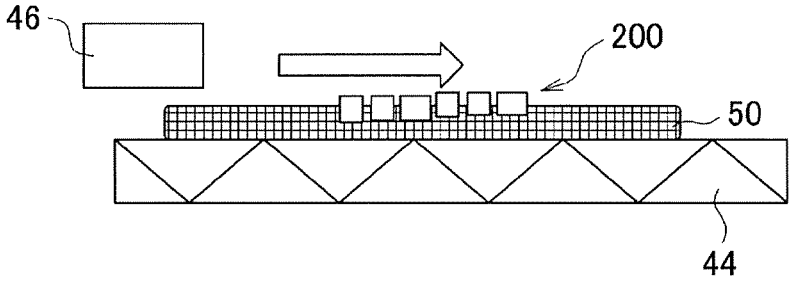

Next, a variant of the operation of printing carried out when using various inks will be described in further detail. FIGS. 4A to 4C are views show one example of an operation of printing in the case of using a latex ink, an aqueous ink, and the like, which are inks that fix to the medium 50 by evaporating the solvent.

Excluding the points described below, the operation of printing shown in FIGS. 4A to 4C is the same as or similar to the operation of printing described using FIGS. 1A to 3C. For example, in the present variant as well, the operations of the screen preparing step S102, the ink discharging step S104, the viscosity increasing step S106, the ink push-in step S108, and the ink fixing step S110 are carried out to perform printing on the medium 50, in a manner similar to the operation of printing described using FIGS. 1A to 3C. Furthermore, excluding the points described below, the configuration in FIGS. 4A to 4C, denoted with the same reference numeral as FIGS. 1A to 3C, has a feature same as or similar to the configuration in FIGS. 1A to 3C. Moreover, in the present variant, the operation of the screen preparing step S102 may be carried out in the same manner as or in a manner similar to the case described using FIGS. 1A to 3C.

FIG. 4A shows one example of the operations of the ink discharging step S104 and the viscosity increasing step S106 carried out in the present variant. In the ink discharging step S104 of the present variant, the ink droplet of the ink to be fixed to the medium 50 by evaporating the solvent is discharged on the screen 102 by the inkjet head 12. In the viscosity increasing step S106, one part of the solvent in the ink is volatilized and removed by heating the screen 102 with the heater 20 to enhance the viscosity of the ink. In such a case, for example, another heating device 22 may be further used in addition to the heater 20, as shown in the figure. A device that emits an infrared ray or a far infrared ray, for example, can be suitably used for the heating device 22. The heating device 22 may be a device dedicated to the viscosity increasing step S106, or may be a device used, for example, also in the ink fixing step S110 and the like, to be carried out later.

Furthermore, the heating device 22 is, for example, arranged on the same side as the inkjet head 12 with respect to the screen 102 in the printing device 10. In this case as well, the viscosity of the ink is preferably enhanced to the viscosity same as or similar to the case described using FIGS. 1A to 3C by volatilizing and removing one part of the solvent in the ink.

FIG. 4B shows one example of the operation of the ink push-in step S108 carried out in the present variant. In the present variant as well, for example, the operation of the ink push-in step S108 can be carried out in the same manner as or in a manner similar to the case described using FIGS. 1A to 3C. Furthermore, in this case, the hold-down sheet 52 such as the film is preferably sandwiched as shown in the figure, for example, between the squeegee 32 used as the push-in member and the screen 102, as necessary.

FIG. 4C shows one example of the operation of the ink fixing step S110 carried out in the present variant. In the ink fixing step S110 of the present variant, the medium 50 is heated using the heater 44, which is the ink fixer, with the screen 102 detached from the medium 50. The solvent in the ink on the medium 50 is thereby further volatilized and removed to fix the ink on the medium. An oven, and the like disposed on a rear side of the medium 50, for example, can be suitably used for the heater 44. Furthermore, the heater 20 used in the viscosity increasing step S106 may also be used as the heater 44.

Furthermore, another heating device 46 may be further used in addition to the heater 44. A device that emits an infrared ray or a far infrared ray, for example, can be suitably used for the heating device 46. Furthermore, for example, the heating device 22 used in the viscosity increasing step S106 may also be used as the heating device 46. Accordingly, for example, the printing on the medium 50 can be appropriately carried out when using the latex ink, the aqueous ink, and the like.

FIGS. 5A to 5D show one example of the operation of printing in the case of using the ultraviolet curing type ink. Excluding the points described below, the operation of printing shown in FIGS. 5A to 5D is the same as or similar to the operation of printing described using FIGS. 1A to 4C. In the present variant as well, the operations of the screen preparing step S102, the ink discharging step S104, the viscosity increasing step S106, the ink push-in step S108, and the ink fixing step S110 are carried out to perform printing on the medium 50, in a manner similar to the operation of printing described using FIGS. 1A to 4C. Furthermore, excluding the points described below, the configuration in FIGS. 5A to 5D, denoted with the same reference numeral as FIGS. 1A to 4C, has a feature same as or similar to the configuration in FIGS. 1A to 4C.

Figure 5A:
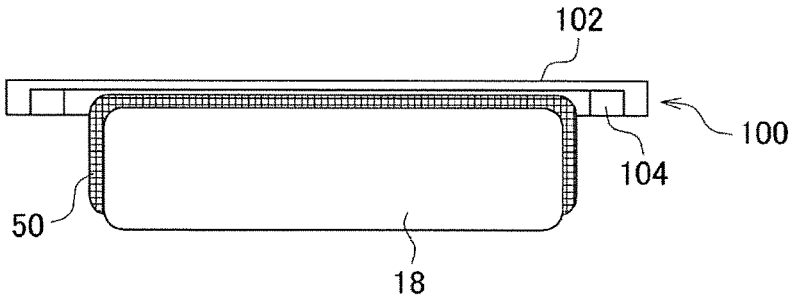
FIGS. 5A to 5D are views showing one example of the operation of printing in the case of using the ultraviolet curing type ink.

FIG. 5A shows one example of the operation of the screen preparing step S102 carried out in the present variant. In the present variant, the operation of the screen preparing step S102 may be carried out in the same manner as or in a manner similar to the case described using FIGS. 1A to 4C. However, when using the ultraviolet curing type ink as in the present variant, the heater 20 (see FIGS. 1A and 1B) does not need to be used in the printing device. Thus, in the printing device used in the present variant, the heater 20 for heating the screen 102 may be omitted.

Figure 5B:
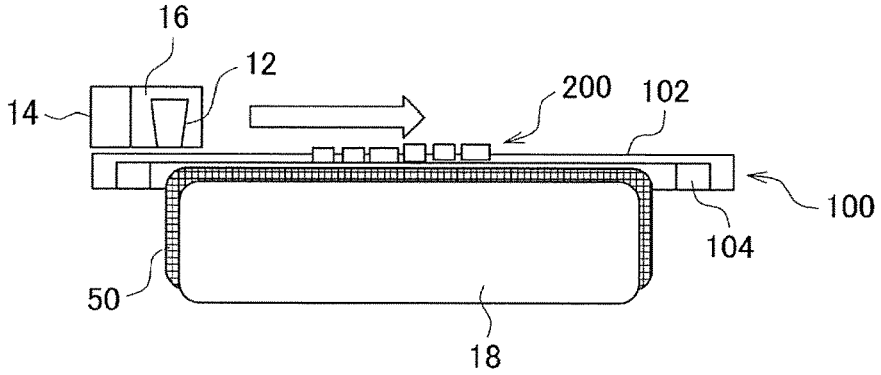

FIG. 5B shows one example of the operations of the ink discharging step S104 and the viscosity increasing step S106 carried out in the present variant. In the ink discharging step S104 of the present variant, the ultraviolet curing type ink is discharged on the screen 102 by the inkjet head 12. Furthermore, in the viscosity increasing step S106, the viscosity of the ink is enhanced by irradiating the ultraviolet ray having the integrated intensity at which the ink does not completely cure using the ultraviolet light source 14. In this case as well, the viscosity of the ink is preferably enhanced to the viscosity same as or similar to the case described using FIGS. 1A to 4C.

Figure 5C:
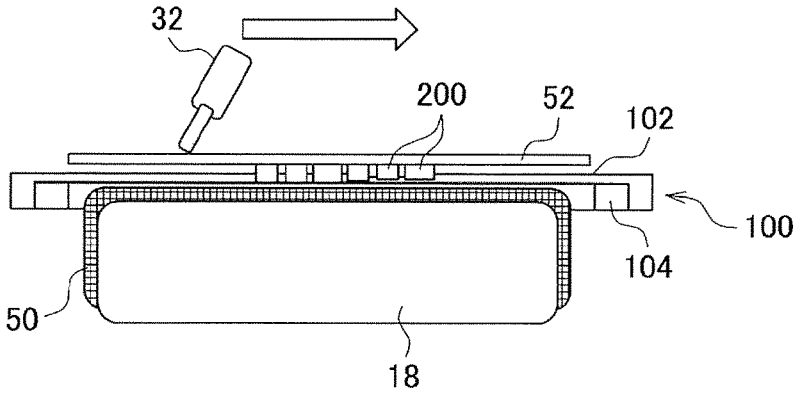

FIG. 5C shows one example of the operation of the ink push-in step S108 carried out in the present variant. In the present variant as well, the operation of the ink push-in step S108 can be carried out in the same manner as or in a manner similar to the case described using FIGS. 1A to 4C. Furthermore, in this case, for example, the hold-down sheet 52 such as the film is preferably sandwiched between the squeegee 32 and the screen 102, as shown in the figure, as necessary.

Figure 5D:
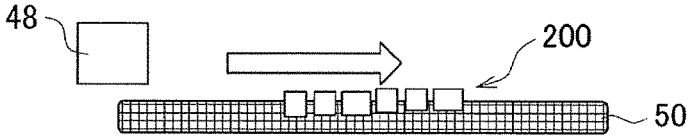

FIG. 5D shows one example of the operation of the ink fixing step S110 carried out in the present variant. In the ink fixing step S110 of the present variant, the ink on the medium 50 is further irradiated with the ultraviolet ray using the ultraviolet light source 48 with the screen 102 detached from the medium 50. The curing of the ink is thereby completed, and the ink is fixed on the medium 50. The ultraviolet light source 48 may be a light source separate from the ultraviolet light source 14 used in the viscosity increasing step S106. Consideration is made to also using the ultraviolet light source 14 as the ultraviolet light source 48. Accordingly, the printing on the medium 50 can be appropriately carried out when using the ultraviolet curing type ink.

Next, a further variant of the operation of printing will be described. In the description made above, a case of pushing in the ink simply with the squeegee 32, and the like has been mainly described for the operation of the ink push-in step S108. However, in the ink push-in step S108, the ink is preferably pushed in from one surface side toward the other surface side of the screen 102 while vibrating the screen 102. In this case, the medium 50 is also preferably vibrated with the screen 102.

According to such configuration, the ink can be more smoothly passed with respect to the screen 102. Furthermore, the ink thus can be more appropriately attached to the medium 50. For example, with respect to a medium that absorbs ink at least to a certain extent as with the fabric medium 50, the ink can be moderately impregnated to the inside of the medium 50 even when the viscosity of the ink is high by applying vibration. The ink thus can be more appropriately attached to the medium 50.

In this case, for example, consideration is made to vibrating the screen 102 by pushing in the ink while vibrating the push-in member such as the squeegee, and the like. In this case as well, a member other than the squeegee such as the roller, the pad, and the like, for example, may be used for the push-in member. The frequency of vibration is preferably set to a frequency at which the push-in efficiency of the ink enhances according to the viscosity of the ink, the property of the screen 102, and the like. The frequency of vibration is in a range of a few to a few dozen kHz. The vibration frequency is preferably in the range of 1 to 90 kHz, and more preferably in the range of about 5 to 50 kHz.

Figure 6A:
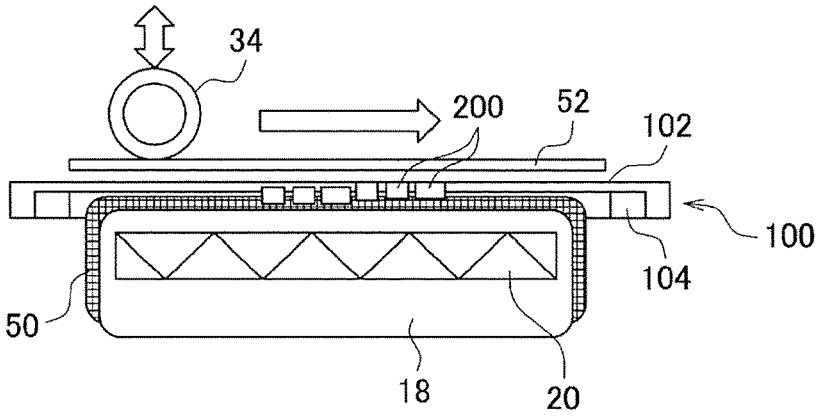
FIGS. 6A to 6C are views showing a further variant of the operation of printing.
Figure 6B:
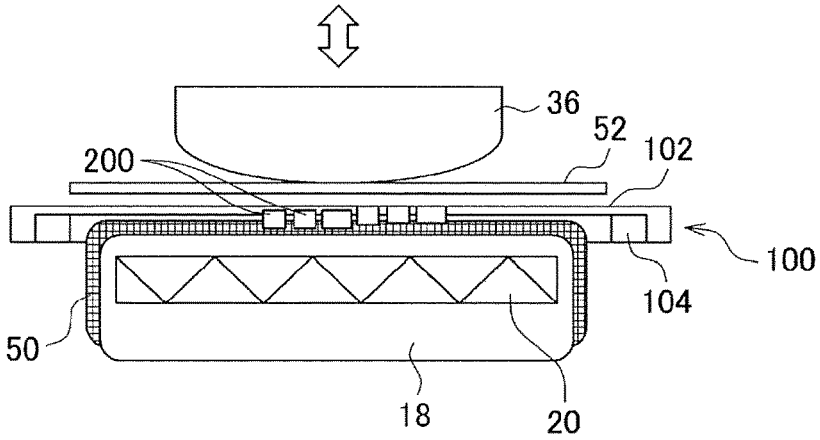
Figure 6C:
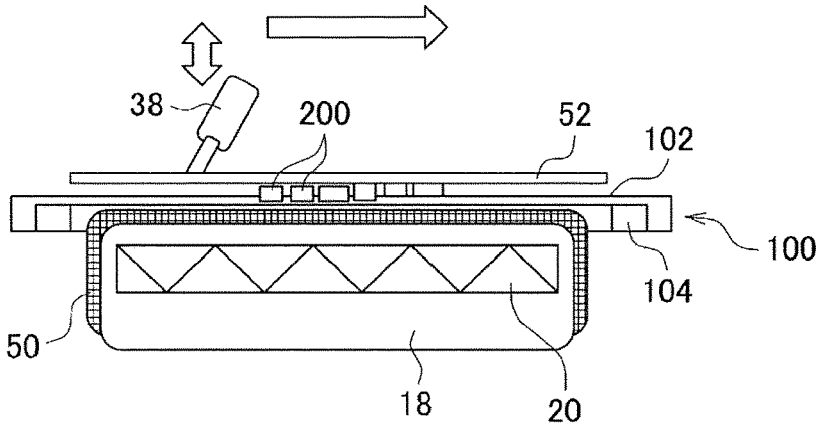

FIGS. 6A to 6C are views showing a further variant of the operation of printing, and show an example of the operation in the case of vibrating the screen 102. FIGS. 6A, 6B and 6C show one example of the operation in the case of using a vibration roller 34, a vibration pad 36, and a vibration squeegee 38 for the push-in member when vibrating the screen 102 in the ink push-in step S108. The vibration roller 34, the vibration pad 36, and the vibration squeegee 38 are a roller, a pad such as a rubber pad, and a squeegee that vibrate at a preset frequency, and vibrate in a direction perpendicular to a surface where the ink is attached in the screen 102 according to the vibration received from a vibration adding device such as a vibrator. Such members are an example of a vibration adding transferring device that transfer the image from the screen 102 to the medium 50 by pushing in the ink while applying vibration.

Excluding the points described below, the operation of the ink push-in step S108 shown in FIGS. 6A to 6C can be carried out in place of the operation of the ink push-in step S108 in the operation of printing described using FIGS. 1A to 5D. Excluding the points described below, the operation of the ink push-in step S108 shown in FIGS. 6A to 6C is the same as or similar to the operation of the ink push-in step S108 in the operation of printing described using FIGS. 1A to 5D. Furthermore, excluding the points described below, the configuration in FIGS. 6A to 6C, denoted with the same reference numeral as FIGS. 1A to 5D, has a feature same as or similar to the configuration in FIGS. 1A to 5D.

As shown in each figure, in the ink push-in step S108 of the present variant, the ink is pushed from one surface side toward the other surface side of the screen 102 while vibrating the vibration roller 34, the vibration pad 36, or the vibration squeegee 38. The ink with enhanced viscosity is thereby passed with respect to the mesh-like screen 102, and the ink is attached to the medium 50. In this case, the ink can be more smoothly passed with respect to the screen 102, as described above. Furthermore, when using the fabric medium 50, and the like, the ink can be moderately impregnated to the inside of the medium 50 even when the viscosity of the ink is high.

Furthermore, when using the medium 50 including gigging such as towel cloth, carpet, and the like, the forced entering of the ink to space between the gigging, and the like, for example, can be advanced by applying pressure while applying vibration to push in the ink. The ink thus can be appropriately impregnated to the back of the medium 50, and even the inside can be appropriately colored or dyed. Furthermore, not limited to the medium 50 including gigging, for example, the ink can be similarly more appropriately attached to the medium 50 even when using the medium 50 (in particular, medium 50 with strong irregularities) having irregularities on the to-be-printed surface.

Thus, according to such configuration, for example, the printing can be more appropriately carried out even with respect to the medium 50 on which printing was difficult with the conventional inkjet printer. In this case as well, the printing can be carried out without using the proof. Thus, for example, high definition printing can be more appropriately carried out while suppressing the cost even when carrying out printing using inks of a plurality of colors.

In the description made above, the relationship between a surface (print surface) on which printing is carried out in the screen 102 and a surface (to-be-transferred surface) on which the ink is attached through the screen 102 in the medium 50 has been described for a case of overlapping the medium 50 and the screen 102 so that a non-print surface, which is the back side of the print surface, in the screen 102 and a to-be-transferred surface of the medium 50 are brought into contact. In this case, the ink is passed with respect to the mesh-like screen 102 to carry out transfer of an image to the medium 50 by applying pressure on the screen 102 in the ink push-in step S108 in the above state. Such method is considered to be particularly preferable when, for example, the ink to be attached to the medium 50 is in large amount, that is, when the ink used for printing is in large amount.

However, a method of overlapping the medium 50 and the screen 102, and the like so that the print surface of the screen 102 is directly brought into contact with the to-be-transferred surface of the medium 50 is also considered for the method of printing using the inkjet head 12 and the screen 102. In this case, for example, consideration is made to carrying out the operation of a transferring step for transferring the image through direct contact of the print surface of the screen 102 and the to-be-transferred surface of the medium 50, in place of the operation of the ink push-in step S108 in the operation of printing described above. More specifically, in the transferring step, for example, the ink with enhanced viscosity is attached to the medium 50 by pressing the screen 102 against the medium 50 with the print surface of the screen 102 and the medium 50 making contact as the operation of transferring the ink, whose viscosity is enhanced in the viscosity increasing step S106, to the medium 50.

Figure 7A:
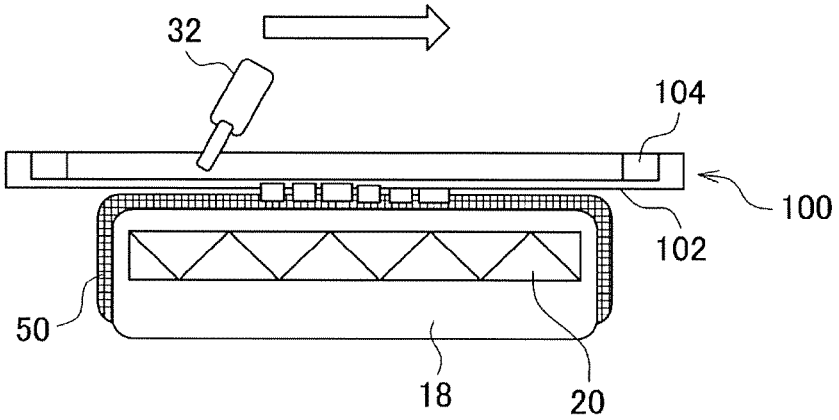
FIGS. 7A and 7B are views showing one example of the operation of a transferring step.
Figure 7B:
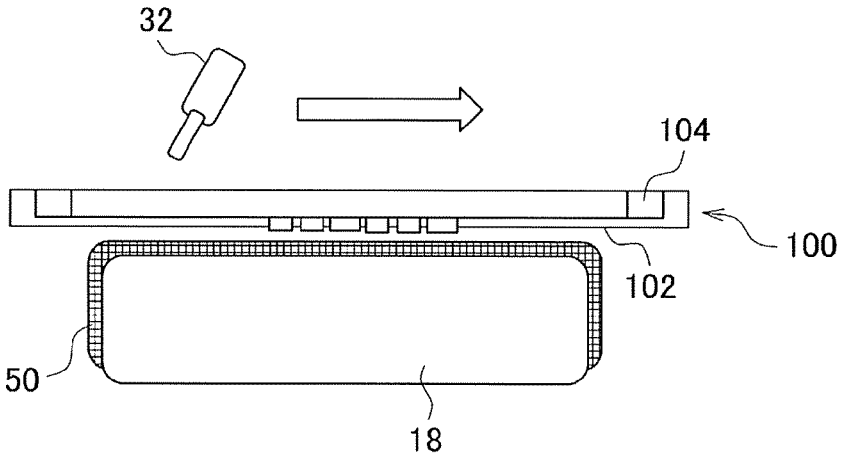

FIGS. 7A and 7B show one example of the operation of the transferring step. Excluding the points described below, the configuration denoted with the same reference numeral as FIGS. 1A to 6C in FIGS. 7A and 7B has a feature same as or similar to the configuration in FIGS. 1A to 6C. Excluding the points described below, the operation of the transferring step described below can be carried out in place of the operation of the ink push-in step S108 in the operation of printing described using FIGS. 1A to 6C.

FIG. 7A shows one example of the operation of the transferring step when using the heater 20 in the viscosity increasing step S106. A case of using the heater 20 in the viscosity increasing step S106 refers to a case of heating the screen 102 in the viscosity increasing step S106 such as, for example, a case of using the solvent UV ink, the aqueous UV ink, the latex ink, the aqueous ink, or the like. FIG. 7B shows one example of the operation of the transferring step when not using the heater 20 in the viscosity increasing step S106. A case of not using the heater 20 in the viscosity increasing step S106 refers to a case of enhancing the viscosity of the ink through a method other than heating in the viscosity increasing step S106 such as, for example, a case of using the ultraviolet curing type ink.

In the case shown in either FIG. 7A or FIG. 7B, the screen 102 and the medium 50 are overlapped so that the print surface of the screen 102 and the to-be-transferred surface of the medium 50 are brought into contact in the transferring step. In such a state, the pressure is applied on the screen 102 using the squeegee 32, and the like to attach the ink on the screen 102 to the medium 50. The image on the screen 102 is thereby transferred to the medium 50. In this case, the squeegee 32, and the like is an example of a transferring member used for transferring. A roller, a pad, and the like, for example, may be used for the transferring member.

Furthermore, in this case, the ink is blended into the medium 50 by holding down the squeegee 32, and thereafter, the ink is fixed to the medium 50. More specifically, for example, the ink is fixed to the medium 50 through a method adapted to the ink to use by carrying out an operation same as or similar to the ink fixing step S110 described using FIGS. 1A to 6C after detaching the screen 102 from the medium 50.

When configured in such manner as well, the viscosity of the ink can be appropriately enhanced to the viscosity suited for transfer by enhancing the viscosity of the ink in the viscosity increasing step S106 carried out before the transferring step. Furthermore, the transfer of the image to the medium 50 can be appropriately carried out by subsequently carrying out the operation of the transferring step. In this case, the extra ink can be absorbed into the screen or toward the other surface side of the screen at the time of transfer in the transferring step, for example, by carrying out the transfer using the mesh-like screen 102. Furthermore, the ink can be appropriately fixed to the medium 50 by carrying out the operation of the ink fixing step S110 after the transferring step.

Thus, according to such configuration, the printing through direct transfer can be appropriately carried out. Furthermore, the printing thus can be appropriately carried out with respect to the medium 50 made from various materials and having various shapes.

Even when attaching the ink to the medium 50 by the operation of the transferring step, the roller, the pad, and the like may be used in place of the squeegee 32. Furthermore, in a manner similar to the case described using FIGS. 6A to 6C, for example, the vibration roller 34, the vibration pad 36, the vibration squeegee 38, or the like may be used. According to such configuration, the ink can be more appropriately blended with respect to the medium 50. Furthermore, the ink thus can be more appropriately attached to the medium 50.

The present invention has been described using an embodiment, but the technical scope of the present invention should not be limited to the scope described in the embodiment above. It is apparent to those skilled in the art that various changes or modifications can be made in the embodiment described above. It is apparent from the description of the Claims that modes in which such changes or modifications are made are also encompassed in the technical scope of the present invention.

INDUSTRIAL APPLICABILITY

The present invention can be suitably used in, for example, the printing method.

The invention claimed is:

1. A printing method for carrying out printing using an inkjet head, the printing method comprising:

a screen preparing step of preparing a screen in mesh shape;

an ink discharging step of drawing an image on the screen by discharging ink from the inkjet head with respect to one surface of the screen;

a viscosity increasing step of enhancing a viscosity of the ink on the screen;

an ink push-in step of pushing in the ink, whose viscosity is enhanced in the viscosity increasing step, from a side of the one surface toward a side of an other surface of the screen, the ink push-in step including pushing in the ink while a medium, or a target object of printing, and the other surface of the screen are making contact to attach the ink with enhanced viscosity to the medium; and an ink fixing step of fixing the ink attached to the medium to the medium.

2. The printing method as set forth in claim 1, wherein the ink push-in step includes: pushing in the ink from the side of the one surface toward the side of the other surface of the screen, while vibrating the screen.

3. The printing method as set forth in claim 1, wherein the medium is a fabric medium having a gigging on a surface; and in the ink push-in step, the other surface of the screen is brought into contact with the surface of the medium while holding down the gigging.

4. The printing method as set forth in claim 1, wherein the screen preparing step causes the medium and the other surface of the screen to be brought into contact; and operations of at least the ink discharging step, the viscosity increasing step, and the ink push-in step are carried out, while maintaining a contact between the medium and the other surface of the screen.

5. The printing method as set forth in claim 1, wherein a plurality of layers of ink with enhanced viscosity are formed on the screen by repeating operations of the ink discharging step and operations of the viscosity increasing step over plural times; and the ink push-in step includes: pushing the plurality of layers of ink toward the medium.

6. The printing method as set forth in claim 1, wherein the ink push-in step uses a push-in member for pushing in the ink on the one surface of the screen toward the other surface to push in the ink toward the medium.

7. The printing method as set forth in claim 6, wherein the push-in member is a slidably moving member that slidably moves on the one surface of the screen; and the ink push-in step includes: pushing the ink on the one surface of the screen toward the medium by slidably moving the slidably moving member with a hold-down sheet, or a sheet for holding down the ink on the screen, sandwiched between the ink on the one surface of the screen and the slidably moving member.

8. The printing method as set forth in claim 1, wherein the inkjet head discharges the ink which is an ultraviolet curing ink that cures by irradiation of an ultraviolet ray;

the viscosity increasing step enhances the viscosity of the ink in a range of viscosity with which the ink passes the screen in the ink push-in step by irradiating the ink with an ultraviolet ray of an integrated intensity under which the ink does not completely cure; and the ink fixing step fixes the ink to the medium by further irradiating the ink on the medium with the ultraviolet ray.

9. The printing method as set forth in claim 1, wherein the inkjet head discharges the ink that fixes to the medium by evaporating a solvent;

the viscosity increasing step enhances the viscosity of the ink in a range of viscosity with which the ink passes the screen in the ink push-in step by volatilizing and removing one part of the solvent in the ink; and the ink fixing step fixes the ink to the medium by further volatilizing and removing the solvent in the ink on the medium.

10. The printing method as set forth in claim 1, wherein the inkjet head discharges the ink that fixes to the medium by being irradiated with an ultraviolet ray after evaporating a solvent;

the viscosity increasing step enhances the viscosity of the ink in a range of viscosity with which the ink passes the screen in the ink push-in step by volatilizing and removing at least one part of the solvent in the ink; and the ink fixing step fixes the ink to the medium by irradiating the ink on the medium with the ultraviolet ray.

11. A printing system for carrying out printing using an inkjet head, the printing system comprising:

an inkjet head that discharges ink to one surface of a screen in mesh shape to draw an image on the screen;

a screen holder that holds the screen with the one surface of the screen facing the inkjet head;

a viscosity increaser that enhances a viscosity of the ink on the screen;

a push-in member that pushes the ink, whose viscosity is enhanced in a viscosity increasing step, from a side of the one surface toward a side of an other surface of the screen, the push-in member pushing in the ink while a medium, or a target object of printing, and the other surface of the screen are making contact to attach the ink with enhanced viscosity to the medium; and an ink fixer that fixes the ink attached to the medium to the medium.

* * * * *